US006004018A

United States Patent [19]

Kawasato et al.

[11] Patent Number: 6,004,018

[45] Date of Patent: Dec. 21, 1999

[54] DEVICE FOR PRODUCING EMBROIDERY DATA ON THE BASIS OF IMAGE DATA

[75] Inventors: Takayuki Kawasato; Shinichi Fuchigami; Haruhiko Tanaka; Yoshitaka Takahashi, all of Hachioji, Japan

[73] Assignee: Janome Sewing Machine, Tokyo, Japan

[21] Appl. No.: 08/799,275

[22] Filed: Feb. 13, 1997

[30] Foreign Application Priority Data

Mar. 5, 1996 [JP] Japan ..... 8-73075
Jun. 7, 1996 [JP] Japan ..... 8-166624

[51] Int. Cl.[6] ..... G06F 19/00; G06G 7/64; G06G 7/66

[52] U.S. Cl. ..... 364/470.09; 364/470.02; 364/470.03; 364/470.07; 364/470.08

[58] Field of Search ..... 364/470.09, 470.01, 364/470.02, 470.04, 470.05, 470.06, 470.07, 470.08, 474.03, 474.24, 474.25, 474.26, 189, 191, 192, 193, 188; 112/102.5, 470.04, 475.19, 121.12, 103, 121.11, 262.3, 266.1, 78, 2, 453, 457

[56] References Cited

U.S. PATENT DOCUMENTS 4,991,524 2/1991 Ozaki ..... 112/121.12
5,195,451 3/1993 Nakashima ..... 112/121.12
5,499,589 3/1996 Kyuno et al. ..... 112/102.5
5,520,126 5/1996 Muto et al. ..... 112/102.5
5,558,032 9/1996 Muto et al. ..... 112/102.5
5,560,306 10/1996 Kyuno et al. ..... 112/102.5
5,563,795 10/1996 Futamura et al. ..... 364/470.09
5,576,968 11/1996 Mizuno et al. ..... 364/470.09
5,592,891 1/1997 Muto ..... 112/475.19
5,740,055 4/1998 Iwata ..... 364/470.1
5,740,056 4/1998 Fatamura ..... 364/470.09

*Primary Examiner*—Reba I. Elmore
*Assistant Examiner*—Ramesh Patel
*Attorney, Agent, or Firm*—Michael J. Striker

[57] ABSTRACT

Disclosed is a device for producing embroidery stitch data on the basis of image data, wherein an image is read in by use of an image scanner and is divided into a plurality of latticed sections. The latticed sections are all searched through one after another and discriminated if each of the sections is stitched or not. Unit stitch patterns are selected to be stitched in the sections respectively which have been discriminated to be stitched, the selected unit stitch patterns including at most two patterns which have different initial stitch points and different end stitch points and are located in predetermined sections respectively.

10 Claims, 7 Drawing Sheets

DEVICE FOR PRODUCING EMBROIDERY DATA ON THE BASIS OF IMAGE DATA

BACKGROUND OF THE INVENTION AND RELATED ART STATEMENT

The present invention relates to an embroidery data producing device and more particularly relates to a device for producing stitch data on the basis of an original image to be stitched by use of a sewing machine.

So far the pattern data used in connection with a sewing machine capable of embroidery stitching and an embroidering machine for exclusively stitching embroidery patterns have been provided by a sewing machine maker, and the user has normally operated the sewing machine by use of the pattern data supplied by the machine maker to enjoy embroider stitching.

However with the recent wide spread of personal computers, the user has come to have a desire to make patterns by herself and to use the pattern data for stitching her own embroidery patterns. Moreover a device for reading the images with an image sensor to make the image data from the images may now be easily available in the market. Actually such a device is now an accessory attached to a sewing machine for sale.

Conventionally it has been general to simply make the mat stitch data when the user makes an image as she likes and to make the embroidery data from the image. Recently a device for edge stitching has been available in the market. However it has been impossible to obtain a device for making data for producing stitches.

The present invention has been developed in consideration of such a circumstance for the purpose of providing a device for producing the embroidery stitch data on the basis of a given image.

SUMMARY OF THE INVENTION

According to the embroidery data producing device of the invention, the image data obtained from an original image by use of an image scanner and the like is divided into predetermined sections such as a plurality of latticed sections which are respectively searched and discriminated if each of the sections is stitched or not. This discrimination may be made by the rate of section area which is occupied by the image.

In a preferred embodiment, the embroidery stitching execution is decided when the area of the sections is occupied by more than 20% of the image. The image data may be usable, which is read in from an original image by use of an image scanner and the like or which is produced by use of a CAD.

The sections decided to be stitched are given a stitching order and unit stitch pattern data are selected to be stitched as the patterns in each of the sections. The stitching order may be predetermined, for example, as to stitch in the lateral directions alternately. The unit stitch pattern data include, as the patterns, those having different initial stitch points and different end stitch points which are appropriately selected in dependence on the positions of the stitch executing sections. The unit stitch pattern data may be all identical as the pattern and may have different initial stitch points and/or different end stitch points and also same initial stitch points and/or same end stitch points. Further the different unit stitch patterns may have same initial stitch points and/or same end stitch points. Thus so many combinations of patterns may be possible.

The selection of the initial and end stitch points is made preferably to prevent the jump threads from being produced between the formed stitches. However in case the jump threads are not avoided, it is preferable to select the unit stitch pattern data so as to rather make remarkable the jump threads because such jump threads may be easily cut away after the embroider stitching has been finished. Fundamentally selection is made such that the initial stitch point of one unit stitch pattern data is located dose to the end stitch point of the unit stitch pattern data in the immediately preceding section in case the stitch executing sections are adjacent.

On the other hand, in case the stitch executing sections are not adjacent in stitching sequence and far from each other, selection may be made such that the distance may be far between ]the end stitch point of one unit stitch pattern data and the initial stitch point of the other one. In this case, the long jump thread is remarkable and may be easily disposed of. Especially when the stitching line is changed, it is preferable to take a long distance between the end stitch point and the initial stitch point of the unit stitch pattern data.

In the preferred embodiment, the image is divided into a plurality of sections arranged in a form of lattice. A unit stitch pattern data is selected in each of the sections along the lateral lines which define stitch executing directions. Selection of the unit stitch pattern data is made on more than one of the following conditions:

(1) If the section is the first section on the line.

(2) If the section is the last section on the line.

(3) If the section is a single section on the line.

Stitching is executed laterally along the lines in one direction on one line and in the opposite direction on the next lower line. In this case, only the same unit stitch pattern data may be arranged on every other line.

In case the image is stitched with a plurality of different colors, it is required to prepare at least two images of different colors to be read in separately by use of the image scanner. In this case, it often happens that the images are party overlapped when these are read in due to the errors of the images or of the image sensor or operation errors. As the result, the overlapped portion will be reduced into data as it is and will be overlappingly stitched.

In order to solve such a problem, it is desired to properly process the data when the decision of stitch execution has been made to the overlapped portion. The data procession will be made by erasing one of the unit stitch pattern data.

Such a data processing method may be provided by making effective one of the unit stitch pattern data in dependence on the order of reading the data as the data are progressively read in by the image scanner, or in dependence on the rate of area the image occupies. For example, the image of smaller area may be preferentially stitched. Moreover the user may give a deciding instruction.

The embroidery data producing device of the invention may be a single and independent one or may be of being incorporated in the embroidering sewing machine, or may be partly independent and partly incorporated in the sewing machine.

BRIEF DESCRIPTION OF THE DRAWINGS

FIG. 2 is a diagrammatic representation showing the operations of the embodiment wherein, FIG. 2(A) is a shape of an image shown by way of example to be converted into stitch data;

FIG. 2(B) is the shape of the image divided into a plurality of sections having optionally selected unit stitch patterns of one type located therein;

FIG. 2(C) is a representation showing the stitch executing section searching directions and the stitching directions of the image;

FIG. 2(D) is a representation showing the stitches forming the shape of the image;

FIG. 3 is a representation of a cross stitch pattern shown as the unit stitch pattern by way of example wherein, FIG. 3(A) is a representation of the cross stitches having different initial stitch points and different end stitch points respectively;

FIG. 3(B) is a representation showing the stitching sequences of the cross stitches;

FIG. 6(2) is a representation showing the different images separately sectioned;

FIG. 6(3) is a representation showing the sections decided to the images and the different unit stitch patterns designated respectively;

FIG. 6(4) is a representation showing the two different images put into combination, in which some sections have the different unit stitch patterns overlapped therein;

FIG. 6(5) is a representation showing the pattern overlapped sections have been appropriately processed.

DETAILED DESCRIPTION OF PREFERRED EMBODIMENTS

The invention will now be described in reference to the preferred embodiments as shown in the attached drawings.

Figure 1:
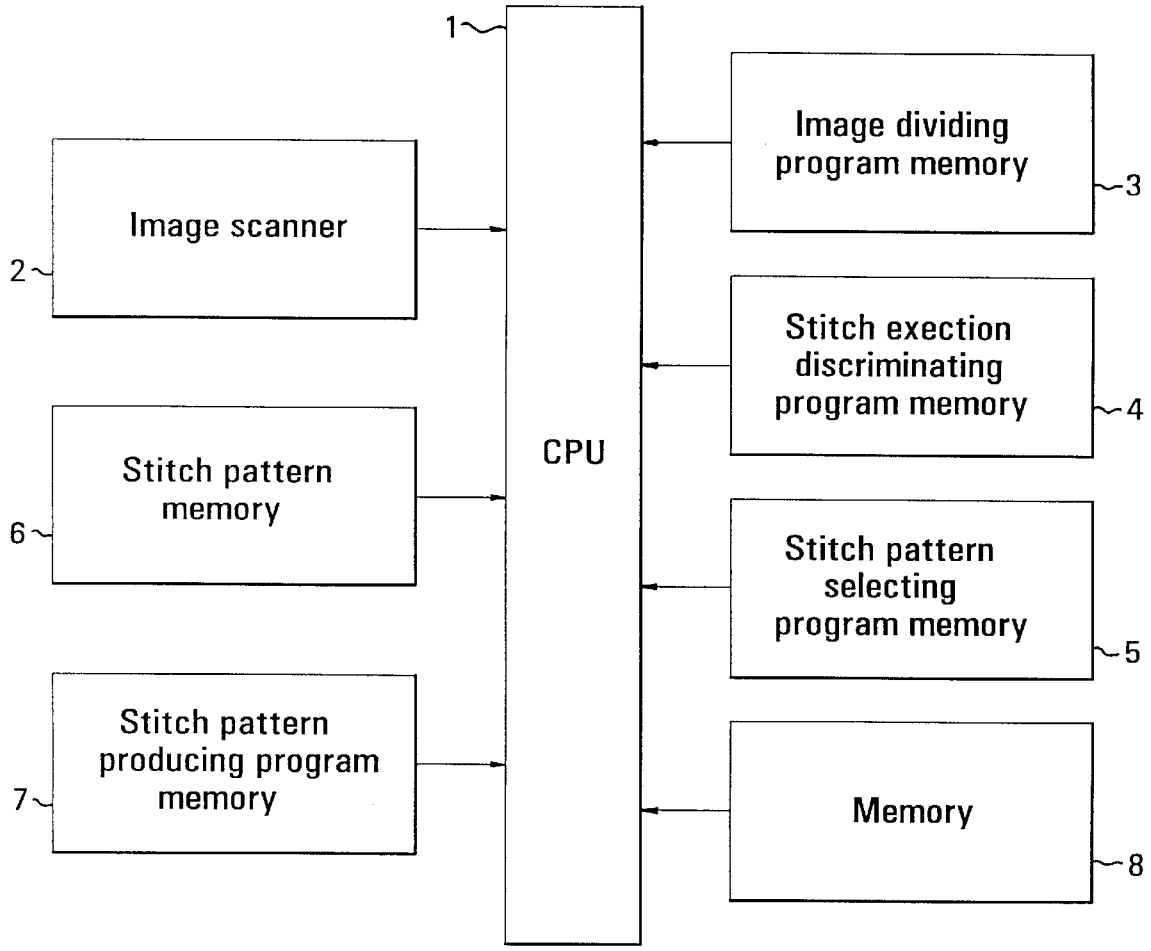
FIG. 1 is a block diagram showing a substantial structure of an embodiment of the invention.
Figure 4:
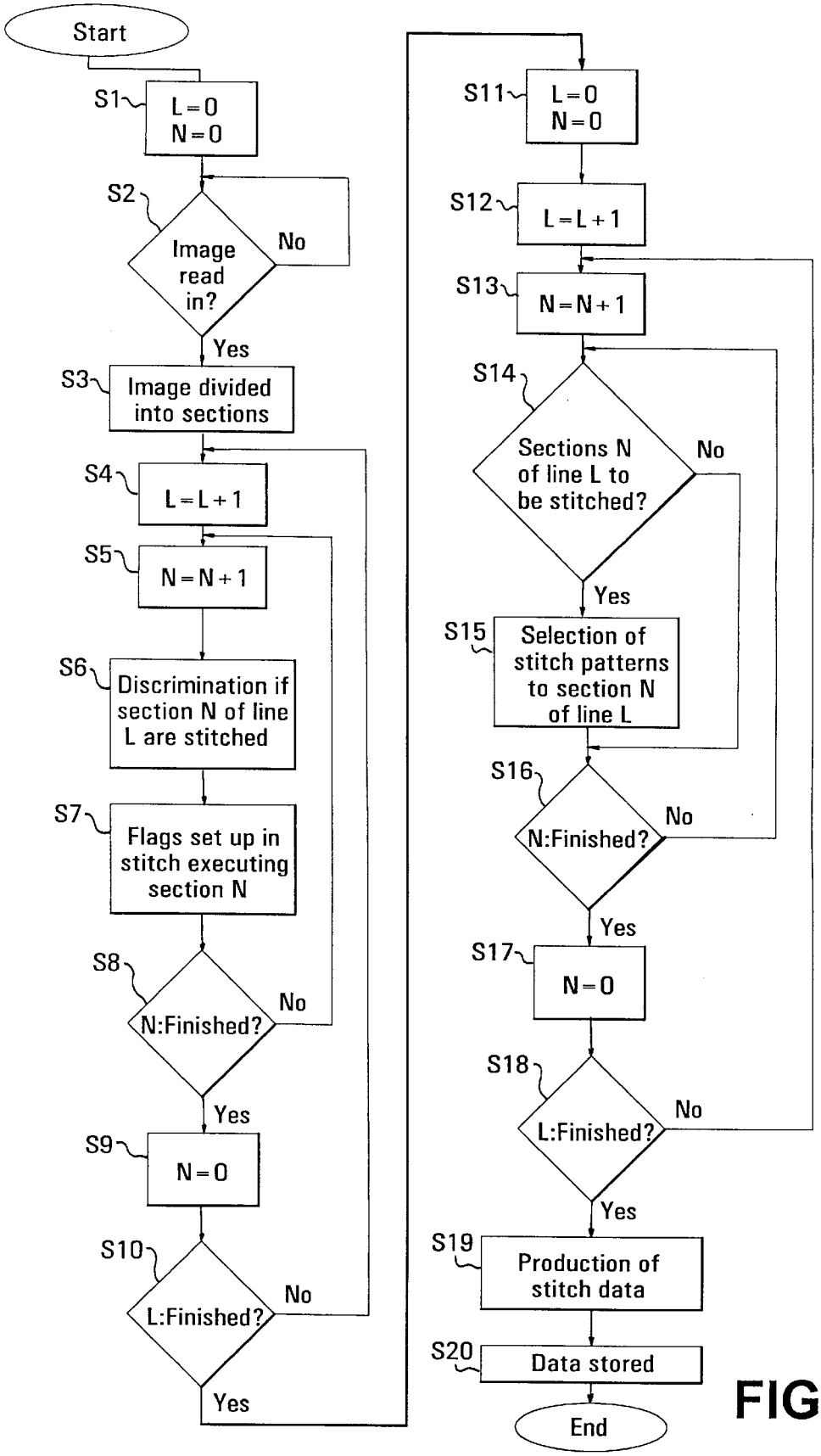
FIG. 4 is a flow chart showing the operations of the embodiment.

FIG. 1 shows an embodiment of the invention including a CPU 1 which is composed of a microcomputer as a main element. FIG. 4 is a flow chart showing the operation of the embodiment.

The CPU 1 has an image scanner 2 connected thereto so that the image scanner may be operated by a user to read therein a desired original image and input the image data into the CPU 1. The image scanner 2 may be replaced by some other image dealing element such as a memory having specific image data stored therein or a CAD and the like.

Figure 2:
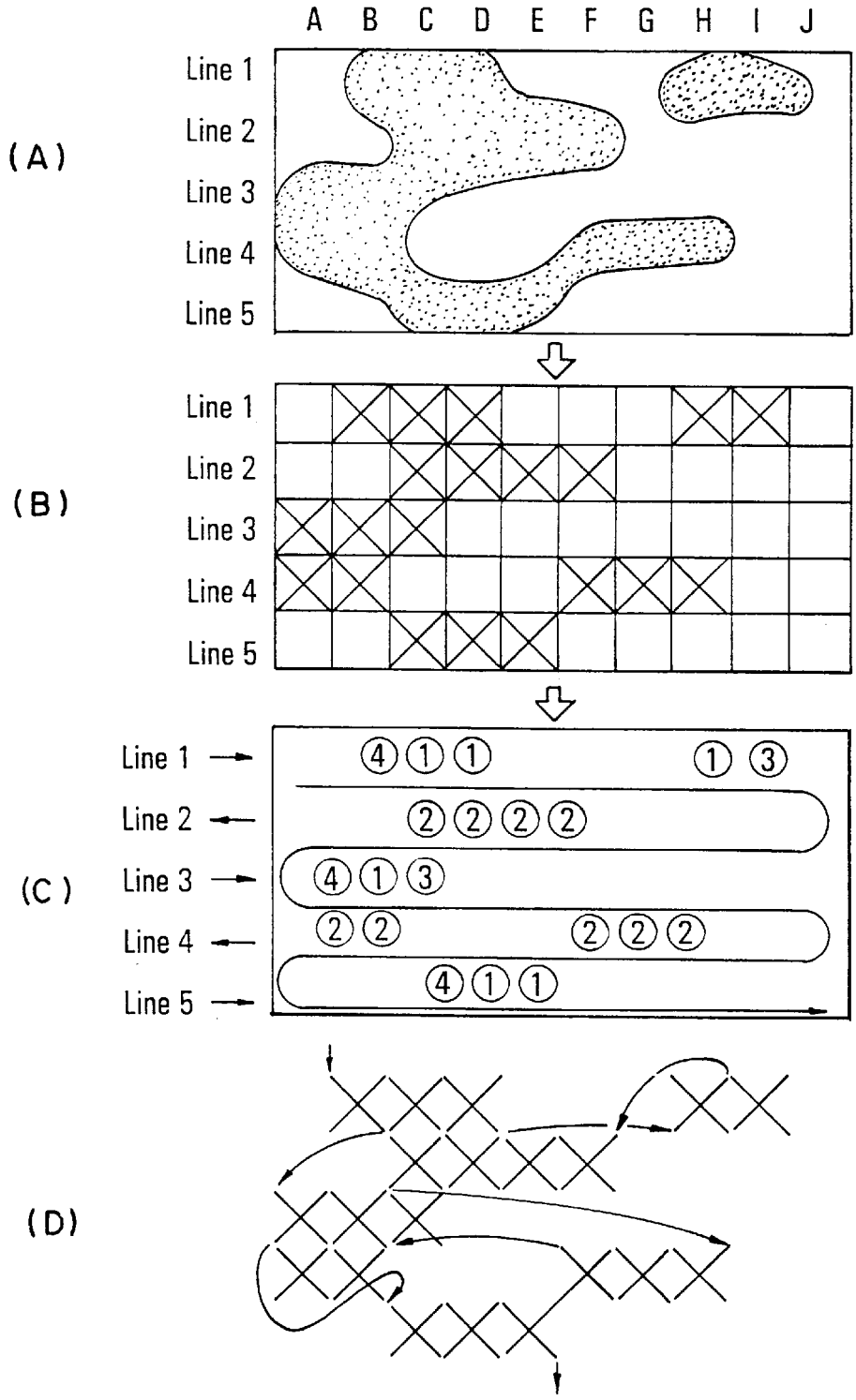

FIG. 2(A) shows an original image by way of example to be read in by the image scanner 2 and entered into the CPU 1 as the image data.

The CPU 1 is operated in accordance with an image dividing program stored in an image dividing program memory 3 to divide the entered image into a plurality of sections.

FIG. 2(B) shows an example of the divisions composed of vertically five and laterally ten of the latticed sections. However actually the divisions are of a resolution of approximately 66×49 latticed sections.

Having divided the image into a plurality of sections, the CPU 1 is operated in accordance with a stitch execution discriminating program stored in a stitch execution discriminating program memory 4 to discriminate each of the sections whether or not each section is stitched.

The discriminating program may be provided, for example, by a generally known algorithm, for making the discrimination in dependence on the rate of section area where a part of the image occupies. According to the embodiment, the stitch execution is decided if the area of the section has a part of the image occupied therein more than 20% of the area.

In FIG. 2(B), the sections having X marks attached thereto are determined to be stitched.

A stitch pattern memory 6 has a plurality of stitch patterns stored therein. The CPU 1 is operated in accordance with a stitch pattern selecting program stored in a stitch pattern selecting program memory 5 to select the stitch patterns to be stitched in the sections respectively where the stitch execution has been decided.

Figure 5:
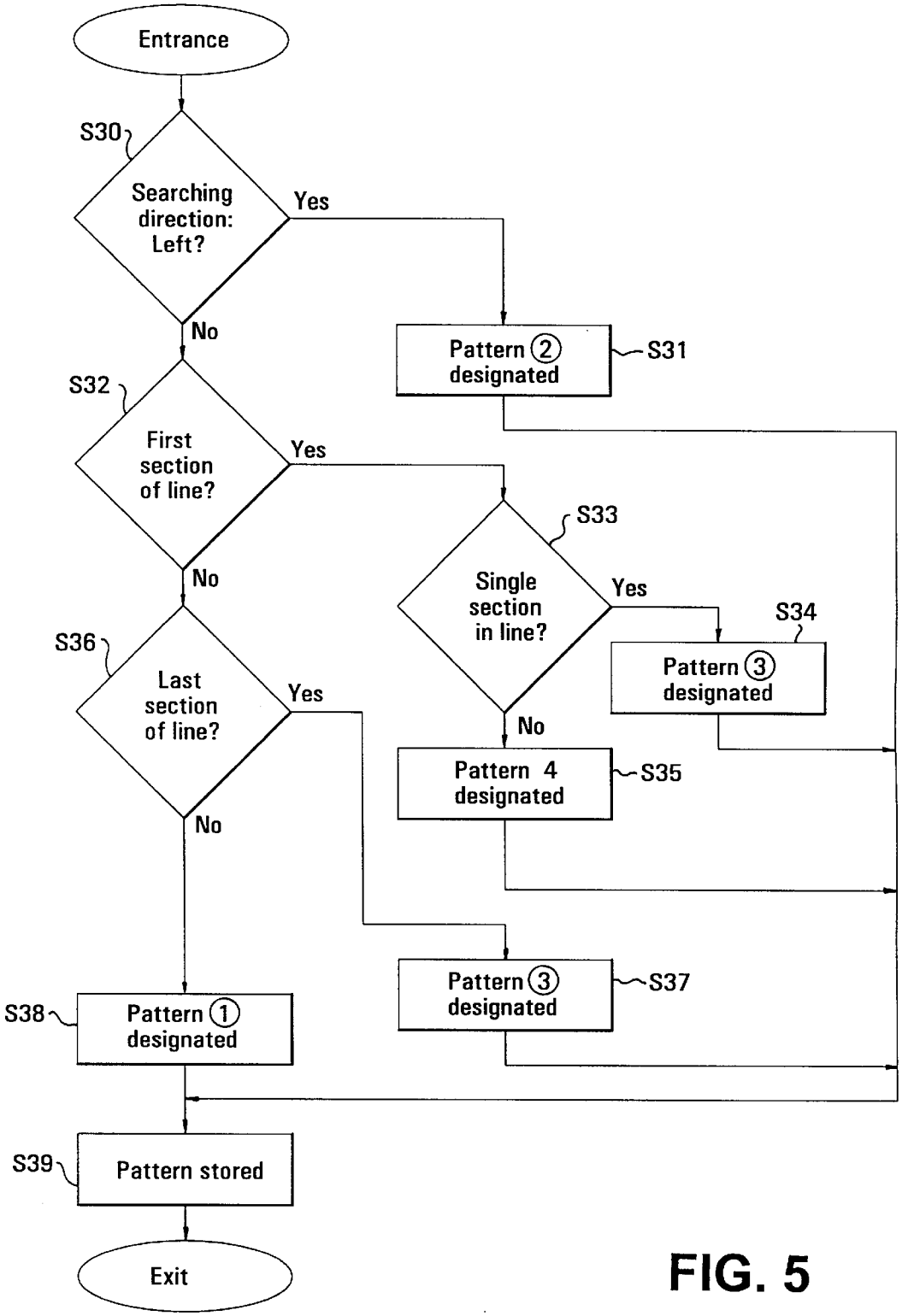
FIG. 5 is a flow chart showing a sub-routine of the flow chart shown in FIG. 4.

The stitch pattern selecting method will now be described. FIG. 5 is flow chart showing the operation of the stitch pattern selecting method.

The stitch patterns include many different patterns which are used in combination to form a completed embroidery image. Each of the stitch patterns has an initial stitch point and an end stitch point. According to the embodiment, the stitch pattern memory 6 stores therein a plurality of identical patterns having the initial stitch points and the end stitch points respectively of different positions.

The CPU 1 will be operated to select the stitch patterns from the stitch pattern memory 6 corresponding to the positions of the sections respectively.

For convenience sake, explanation will now be made as to the cross stitch as shown in FIG. 3(A).

Figure 3:
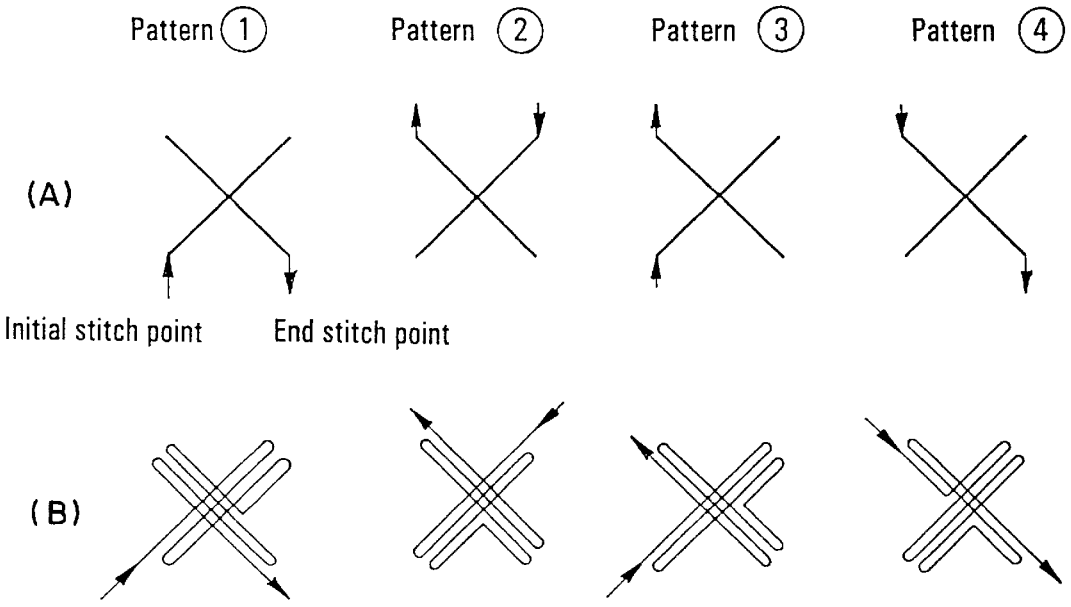

In FIG. 3, a pair of arrow marks show the initial stitch point and the end stitch point respectively. In this case, depending upon the positions of the arrow marks, four identical patterns (1)~(4) are stored. FIG. 3(B) shows the four identical patterns, but actually different in formation of the stitches in dependence on the positions of the initial and end stitch points.

As shown in FIG. 2(C), the CPU 1 will continuously search through the line 1 from left to right, the line 2 from right to left and the line 3 from left to right to select the sections to be stitched. It is noted that the looking up directions correspond to the actual stitch executing directions of the patterns.

The pattern (1) is used to execute stitching fundamentally in the right direction, and the first section and the last section on the line are applied with the patterns (4) and (3) respectively. The section singly isolated on the line is applied with the pattern (3). Since the pattern (1) is adjacent to the end stitch point of the preceding section and to the initial stitch point of the following section, a jump will not exist and the stitches will be continuously formed without an waste thread appearing.

The pattern (2) is used to execute stitching in the left direction. According to the embodiment, all the sections on the lines 2 and 4 are stitched by use of the pattern (2). Namely the identical patterns are provided on every other line. This is because the change of pattern for tracing the continued lines is made on every other line. No jump thread will appear between the patterns (2) too.

Therefore the selection of the stitch patterns is decided by the algorithm which is formed on the basis of the following conditions:

(a) The stitch executing direction.

(b) If the section of the stitch executing direction is the first section on the line.

(c) If the section of the stitch executing direction is the last section on the line.

(d) If the section of the stitch executing direction is a singly isolated section on the line. Since the line 1 extends in the right direction and the stitch execution is in the same direction, the pattern (1) is employed. However the first section 1-B corresponds to the above mentioned condition (b), and therefore the pattern (4) is selected. Since the section 1-I corresponds to the above mentioned condition (c), the pattern (3) is employed. The employment of the pattern (3) at the last section is because the jump thread will extend from the upper part of the section when the stitch is transferred to the lower line and therefore will be easily recognized and also will be easily cut away.

The line 2 extends in the left direction and the stitch execution is in the same direction and all patterns (2) are selected. Since the change of the pattern for switching the line is undertaken by the lines 1, 3 and 5, it becomes possible to use the identical patterns on the lines 2 and 4.

On the lines 3, 4 and 5, the stitch patterns are selected in the same method, and the patterns (1)~(4) are selected as shown in FIG. 2(C).

FIG. 2(D) shows the actual stitches of the patterns as selected in the above mentioned method. As is apparent from FIG. 2(D), no jump thread is produced in the continued sections. On the other hand, since the jump thread is made considerably long as mentioned above when the stitch is transferred between the lines, the jump thread is easily recognized and is easily cut away.

The pattern selecting method as mentioned above is one embodiment, and other different methods may be employed. Further the stitch patterns other than the cross stitch may be employed. Further the combination of the initial stitch point and the end stitch point may be variously altered.

The arrangement of the sections is not limited to the rectangular latticed arrangement of the sections of the embodiment as shown. Other polygonal sections and the sections displaced from each other on each of the lines and the arrangement thereof may be employed. Having finished the selection of the stitch patterns in connection with the sections, the CPU 1 is operated in accordance with a stitch data producing program stored in a stitch data producing program memory 7 to produce the stitch data on the basis of the selected stitch patterns, and store the stitch data in a stitch data memory 8.

The stitch data memory 8 may be an IC card and the like by way of example. This card may be attached to an embroidering machine so that the embroidering machine may be operated in accordance with the stitch data stored in the card to execute the embroidery stitching operation.

The operations of the embodiment of the invention will now be described again in reference to the flow charts as shown in FIG. 4.

Firstly the line number L and the section number N are cleared (Step S1). Then an image is read in by use of the image scanner (Step S2). Then the read-in image is divided into a plurality of sections (Step S3). Then the divided sections are discriminated respectively if these sections are all stitched on each line (Steps S4, S5, S6, S7, S8, S9, S10).

Then the line number L and the section number N are cleared again, and all the lines are continuously and sequentially searched through in one direction on one line and in the opposite direction on the next lower line. Then the stitch patterns are selected to be designated to the sections respectively where the stitch execution is decided (Steps S11, S12, S13, S14, S15). When the stitch patterns are selected in all the sections on all lines where the stitch execution is decided (Steps S16, S17, S18), the stitch data are produced on the basis of the selected patterns for stitching the image which has been read in by use of the image scanner (Step S19). Then the stitch data are stored in the memory 8 (Step S20).

Subsequently the subroutine at the Step S15 will now be described in reference to the flow chart as shown in FIG. 5.

In case the searching direction (stitching direction) is from right to left (Step S30), the pattern (2) is selected (Step S30).

In case the searching direction is left to right, the section is discriminated if the section is sequentially the first section or not on the line (Step S32). If the section is the first section, it is discriminated if the line has only one section located thereon (Step S33). If the section is only one on the line, the pattern (3) is selected (Step S34). If more than two sections are located on the line, the pattern (4) is selected (35).

If the section is sequentially not the first section on the line at the Step S32, it is discriminated if the section is sequentially the last section or not (Step S36). If the section is the last one, the pattern (3) is selected (Step S37). On the other hand, if the section is not the last one, the pattern (1) is selected (Step S38). Then the selected pattern is stored in the memory 8.

Thus according to the embroidery data producing device of the invention as mentioned above, the stitch data may be produced from the optional image data, wherein the jump threads are prevented from being produced in the stitches of the original image and the jump threads, when produced, may be easily eliminated.

Figure 6:
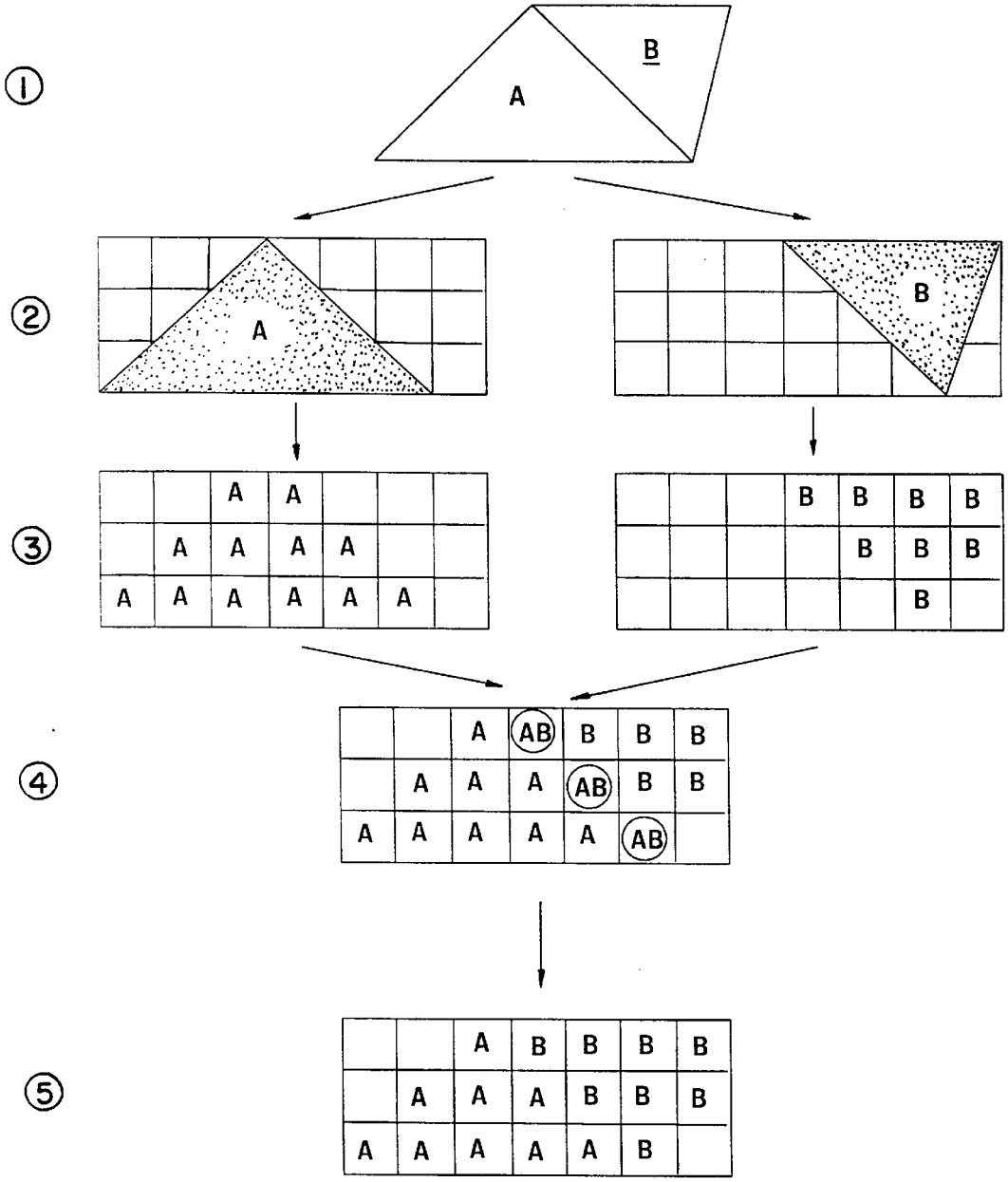
FIG. 6 is a diagrammatic representation showing the operations of a second embodiment of the invention wherein, FIG. 6(1) is a representation of an image which is a combination of two different shapes of images shown by way of example.

FIG. 6 shows another embodiment of the invention. Namely FIG. 6 (1) shows an example of an original image which is composed of an image A and another image B which my be of different colors or of different modes of stitches.

The original images A and B are provided to be separately read in by use of the image scanner 2.

The CPU 1 is operated in accordance with the image dividing program stored in the image dividing program memory 3 to divide the read-in images respectively into a plurality of sections.

FIG. 6(2) shows, for convenience sake, an example of divisions composed of vertically three and laterally seven of latticed sections. However actually the divisions are of a resolution of approximately 66×49 latticed sections. The images A and B are separately divided into a plurality of sections.

Having divided the images into a plurality of sections, the CPU 1 is operated in accordance with the stitch execution discriminating program stored in the stitch execution discriminating program memory 4 to discriminate each of the sections if each section is stitched or not.

The discriminating program may be provided, for example, by a generally known algorithm for making the discrimination in dependence on the rate of section area. According to this embodiment, the stitch execution may be decided if the area of the section has a part of the image occupied therein more than 20% of the area as is the same with the first embodiment.

The CPU 1 is operated in accordance with the algorithm as mentioned above to select the stitch patterns from the stitch pattern memory 6 to the sections respectively.

In FIG. 6(3), the sections having the marks A and B are stitch executing sections, and the marks A and B indicate the stitch patterns of different colors.

FIG. 6(4) shows the images A and B put into combination, which includes the sections in which the stitch patterns A and B are stitched together.

The reason why the stitch executing sections are overlapped may be caused by the stitch execution discriminating algorithm of this embodiment, by the operation errors of the image scanner 2 including hand shaking at the time of reading in the image or by optionally overlapping the images.

In case the different stitch patterns are overlapped in one section, the CPU 1 will so operate as to decide one pattern to be stitched and erase the data of the other pattern.

In order to decide one pattern to be stitched, it is possible to execute stitching the pattern in dependence on the order in which the patterns are read in by the image scanner 2. For example, the pattern read in later may be stitched in preference to the pattern precedingly read in. Alternately the stitch execution may be decided in dependence on the rate of pattern area in a predetermined range. For example, a smaller image may be stitched in preference to a larger one.

Further it is possible to enable the user to designate the pattern to be erased.

If the images A and B are put into combination with determination of stitch execution in accordance with the procedure as mentioned above, the combination of the images is as shown in FIG. 6(5), wherein no overlapped portion exists between the images A and B and each of the stitch executing sections has a single stitch pattern designated therein. In this embodiment, the overlapped portions between the images A and B are all stitched with the stitch pattern data designated to the image B.

Figure 7:
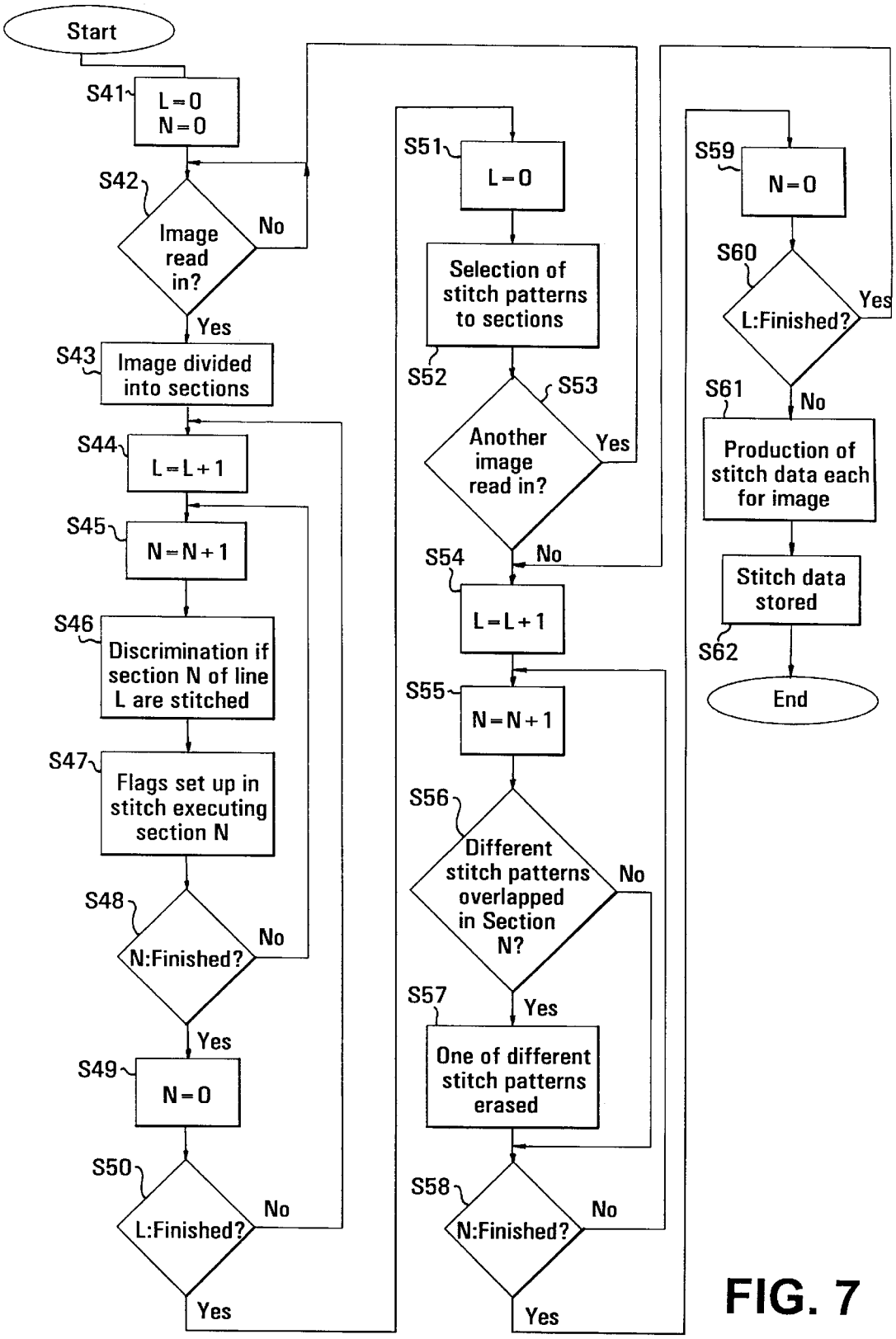
FIG. 7 is a flow chart showing the operations of the second embodiment.

The operations of the embodiment as mentioned above will now be described again in reference to the flow chart as shown in FIG. 7.

Firstly the line number L and the section number H are cleared (Step S41). Then the image is read in by use of the scanner 2 (Step S42). Then the image is divided into the sections (Step S43). Then each of the sections on each of the lines is discriminated if each section is stitched (Steps S44, S45, S46, S47, S48, S49, S50).

The line number L is then cleared (Step S51). Then all the lines are continuously and sequentially searched through in one direction on one line and in the opposite direction on the next lower line so as to discriminate if each of the sections is stitched, and the appropriate stitch pattern is selected to the sections which are discriminated to be stitched (Step S52).

On the other hand, in case another image is read in (Step S53), the routine is returned to Step S2. If there is no image to be subsequently read in, each of the sections is discriminated if each section is overlapped with different images (Steps S54, S55, S56). If some sections have been discriminated to be overlapped, the pattern data of one image are erased in each of the sections (Step S57).

When the image overlap check and the data erasure of one image are finished in all the sections on all lines (Steps S58, S59, S60), the stitch data are produced on the basis of the selected stitch patterns for each of the images (Step S61). The produced stitch data are stored in the memory 8 (Step S62).

It will be understood from the foregoing explanation that this embodiment of the invention is effective to produce the stitch data from the images to be stitched in combination, for forming apparently beautiful stitches of the images, wherein no overlap of different types of stitches will exist.

What is claimed is:

1. An embroidery data producing device comprising:

(a) means for giving data representing an image to be stitched;

(b) means for dividing said image into a plurality of sections which contain parts of the image;

(c) means for searching each of said divided sections to discriminate if each of said divided sections is stitched or not;

(d) means for deciding an order for sequentially stitching said sections which have been discriminated to be stitched;

(e) means for providing stitch data for a plurality of different unit stitch patterns to be stitched in said sections respectively which have been discriminated to be stitched, said unit stitch patterns including a plurality of unit stitch patterns having different initial stitch point and different end stitch point respectively in said sections; and (f) means for selecting stitch data for one of said unit stitch patterns which is to be stitched in said sections which have been discriminated to be stitched.

2. The device as defined in claim 1, wherein said stitch data selecting means is operative to select one of said unit stitch patterns in one of said sections, said selected pattern having the initial stitch point which is positioned close to the end stitch point of the unit stitch pattern selected in the immediately preceding section in stitching sequence.

3. The device as defined in claim 1, wherein said stitch data selecting means is operative to select one and another of said unit stitch patterns in stitching sequence, the types of said one and another unit stitch patterns respectively being such that the end stitch point of said one unit stitch pattern and the initial stitch point of said another unit stitch pattern are directed far from each other when the sections of said one and another unit stitch patterns are not adjacent to each other.

4. The device as defined in claim 1, wherein said image dividing means is operative to divide said image into vertically and laterally arranged plural latticed sections; said stitching order deciding means is operative to decide a stitching order laterally on each of lateral lines defining each of lateral arrangements of said latticed sections; and said stitch data selecting means is operative to select one and another of said unit stitch patterns in stitching sequence, the types of said one and another unit stitch patterns being such that the end stitch point of said one unit stitch pattern and the initial stitch point of said another unit stitch pattern are directed far from each other when said one unit stitch pattern is in the last section on one of said lateral lines and said another unit stitch pattern is in the first section on the immediately lower line.

5. The device as defined in claim 1, wherein said image dividing means is operative to divide said image into vertically and laterally arranged plural latticed sections; said stitching order deciding means is operative to decide a stitching order laterally on each of lateral lines defining each of lateral arrangements of said latticed sections; and said stitch data selecting means is operative to select said unit stitch patterns in said sections respectively on the basis of at least one of the conditions such as (1) if the section to be stitched is the first section on the line, (2) if the section to be stitched is the last section on the line, and (3) if the section to be stitched is an isolated single section on the line.

6. The device as defined in claim 5, wherein said stitching order deciding means is operative to decide a stitching order such that said unit stitch patterns are stitched laterally and sequentially along said lateral lines in one direction on one line and in the opposite direction on the next lower line; and said stitch data selecting means is operative to locate said unit stitch patterns on every other line of said lateral lines, said unit stitch patterns having the same initial stitch points and the same end stitch points.

7. An embroidery data producing device comprising:

(a) means for giving data representing an image to be stitched;

(b) means for dividing said image into a plurality of sections which contain parts of the image;

(c) means for searching each of said divided sections to discriminate if each of said sections is stitched or not;

(d) means for providing stitch data for a plurality of different unit stitch patterns to be stitched in said sections respectively which have been discriminated to be stitched, said unit stitch patterns including a plurality of unit stitch patterns having different initial stitch point and end stitch point respectively in said sections;

(e) means for selecting stitch data for at least two different unit stitch patterns of said plurality of different unit stitch patterns in said sections which have been discriminated to be stitched; and (f) means for processing said selected stitch data for said at least two different unit stitch patterns such that only one of said selected stitch data may be effective for stitching only one of said two different unit stitch patterns in any of said sections which have been discriminated to be stitched when said at least two different unit stitch patterns have been discriminated to be stitched in the same sections respectively.

8. The device as defined in claim 7, wherein said data giving means is an image scanner which is operated to read in said image; and said data processing means is operative to process said selected stitch data for said at least two different unit stitch patterns in dependence on a sequence of progressively reading in at least two different images while said at least two unit stitch patterns have been selected for said at least two images.

9. The device as defined in claim 7, wherein said data processing means is operative to make effective only one of said selected stitch data for said at least two different unit stitch patterns in dependence on a rate of said at least two different unit patterns which occupy in a predetermined range of the sections.

10. The device as defined in claim 7, wherein said data processing means is operative to make effective only one of said selected stitch data for at least two different unit stitch patterns in response to the optional selection by a user of one or the other of said at least two different unit stitch patterns.

* * * * *